US006276551B1

(12) United States Patent
Miller, II

(10) Patent No.: US 6,276,551 B1
(45) Date of Patent: Aug. 21, 2001

(54) FLEXIBLE CAP FOR VARIOUS DRINK CONTAINERS

(76) Inventor: Carol G. Miller, II, 10735 5$^{th}$Ave. Cutoff, #108, Countryside, IL (US) 60525

( * ) Notice: Subject to any disclaimer, the term of this patent is extended or adjusted under 35 U.S.C. 154(b) by 0 days.

(21) Appl. No.: 09/351,377

(22) Filed: Jul. 12, 1999

Related U.S. Application Data

(60) Provisional application No. 60/094,458, filed on Jul. 29, 1998.

(51) Int. Cl.$^{7}$ ..... B65D 65/02

(52) U.S. Cl. ..... 220/287; 215/319; 150/154

(58) Field of Search ..... 215/316, 317, 215/319, 230, 228; 220/287, 257, 258, 906, 703; 229/400, 404, 906.1; 150/154; 206/805

(56) References Cited

U.S. PATENT DOCUMENTS

| | | | | |
|---|---|---|---|---|
| 2,064,411 | * | 12/1936 | Brandstein | 220/287 |
| 2,080,108 | * | 5/1937 | Brandstein | 220/287 |
| 2,490,451 | * | 12/1949 | Magid | 150/154 |
| 2,821,230 | * | 1/1958 | May | 150/154 |
| 3,862,614 | * | 1/1975 | Kovac | 215/317 |
| 4,699,290 | | 10/1987 | Adams . | |
| 4,901,881 | * | 2/1990 | McElroy | 220/287 |
| 5,016,774 | * | 5/1991 | Rodriguez | 150/154 |
| 5,111,961 | | 5/1992 | Van Melle . | |
| 5,197,624 | | 3/1993 | Dodaro . | |
| 5,253,781 | | 10/1993 | Van Melle . | |
| 5,415,312 | | 5/1995 | Mueller . | |
| 5,454,492 | * | 10/1995 | Hunter et al. | 150/154 |
| 5,709,312 | * | 1/1998 | Lake | 220/287 |

FOREIGN PATENT DOCUMENTS

| | | | | |
|---|---|---|---|---|
| 988458 | * | 5/1976 | (CA) | 150/154 |
| 474420 | * | 6/1969 | (CH) | 220/257 |
| 3047182 | * | 7/1982 | (DE) | 150/154 |
| 36028 | * | 6/1925 | (DK) | 215/317 |
| 2238303 | * | 5/1991 | (GB) | 220/287 |

* cited by examiner

*Primary Examiner*—Nathan J. Newhouse
(74) *Attorney, Agent, or Firm*—Mark E. Wiemelt

(57) ABSTRACT

A novel drink cap (10) for preventing foreign substances from entering an opening (12) of a beverage container (18), the drink cap (10) comprising at least one flexible non-wetting sheet (22) that has an outer surface (24), an inner surface (26), an edge portion (28) located at the outermost periphery of the flexible sheet (22), a skirt portion (34) located adjacent to the edge portion (28), an elastic periphery region located adjacent to the skirt portion (34), and a central web portion (30), whereby the central web portion (30) of the inner surface (26) of the at least one flexible sheet (22) covers the opening (12) of the beverage container (18). The present invention is also directed to a method for covering an opening (12) of a beverage container (18) using the novel drink cap (10).

1 Claim, 3 Drawing Sheets

FLEXIBLE CAP FOR VARIOUS DRINK CONTAINERS

PRIORITY

This is a nonprovisional application of provisional patent application Ser. No. 60/094,458 filed Jul. 29, 1998,

BACKGROUND OF THE INVENTION

1. Field of the Invention

The present invention relates generally to closures, caps, covers or lids for beverage or other liquid containers. More particularly, the present invention relates to caps having a dilating elastic perimeter region to accommodate wide varieties of beverage container openings.

2. Description of the Related Art

The novel drink cap provides beverage consumers a remedy against the increasing use of illegal substances, such as rohypnol, by deviants adding such substances into an unsuspecting beverage consumer's drink. The use of rohypnol gives criminals a method to render a person incapacitated and thereafter commit such heinous crimes as rape, robbery and kidnapping on the defenseless victim. Unfortunately, bars and nightclubs offer criminals an opportune dimly lit forum wherein potential victims are easily and unknowingly taken advantage of.

It is, therefore, an object of the present invention to provide a remedy for this long sought, yet currently unsolved, need by presenting beverage consumers with a drink cap which is easily applied to a variety of styles of beverage containers. Other objects of the instant invention will be apparent in the disclosures hereafter.

BRIEF SUMMARY OF THE INVENTION

It is an important object of the present invention to provide an improved drink cap.

It is another object of the present invention to provide an improved drink cap which can be used with a variety of beverage container sizes and shapes.

It is a further object of the invention to provide an improved drink cap adapted to display logos for marketing purposes.

It is yet as another object of the present invention to provide an improved drink cap which can be efficiently manufactured with regard to apparatus materials and labor, and can be easily marketed to the buying public at low sale prices.

It is another object of the present invention to provide an improved drink cap that is easily utilized and advantageous to a user.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

A broad aspect of the invention involves an improved drink cap used to cover beverage containers 18 to prevent foreign substances from entering therein. The drink cap 10 is made of at least one flexible non-wetting sheet 22 that has an outer surface 24 and an inner surface 26. From the outermost periphery of the flexible sheet 22 toward the center thereof, the flexible sheet 22 also has an edge portion 28, a skirt portion 34, an elastic periphery region 32, and a central web portion 30.

In usage, the drink cap 10 is expanded or dilated by an individual grasping the opposing first skirt portion 36 and second skirt portion 38, and pulling them in opposite directions. Then, the central web portion 30 of the inner surface 26 is placed on the opening 12 of the beverage container 18. After that, the individual releases the first skirt portion 36 and the second skirt portion 38 which automatically allows the flexible sheet 22 to tightly fit around and cover the opening of 12 the beverage container 18. A major advantage of this invention is that the drink cap 10 is made to fit most, if not all, conventional beverage containers 18.

In nightclub and bar settings, where the lighting is usually dim, a drink cap 10 of the instant invention may be placed upon the beverage container 14, 16 and 18 when the beverage consumer is inattentive to such beverage containers 14, 16 and 18, and removed each time the beverage consumer wishes to consume the beverage.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

BRIEF DESCRIPTION OF THE SEVERAL VIEWS OF THE DRAWINGS

The foregoing and other additional objects of the present invention will be readily appreciated by those skilled in the art upon gaining an understanding of the invention as described in the following detailed description and shown in the accompanying drawings in which.

DETAILED DESCRIPTION OF THE INVENTION

Figure 1:
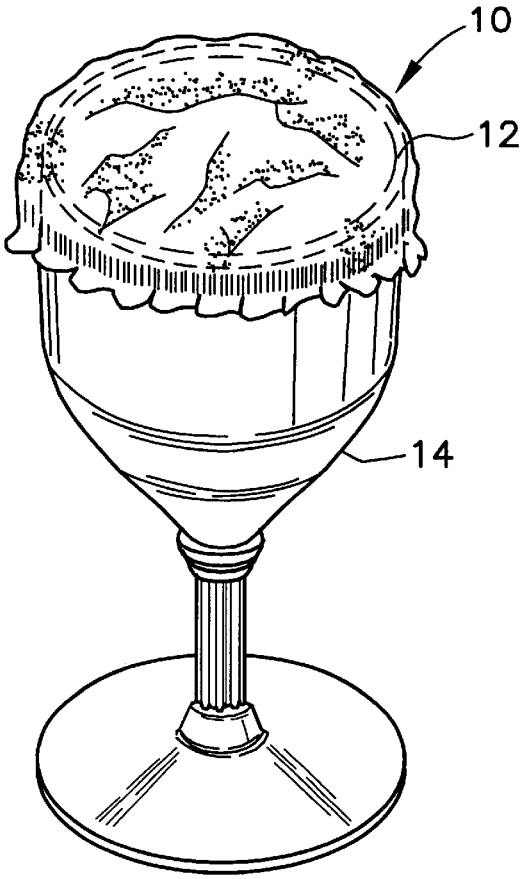
FIG. 1 is a side elevational view of a typical wine glass utilizing the present invention drink cap.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
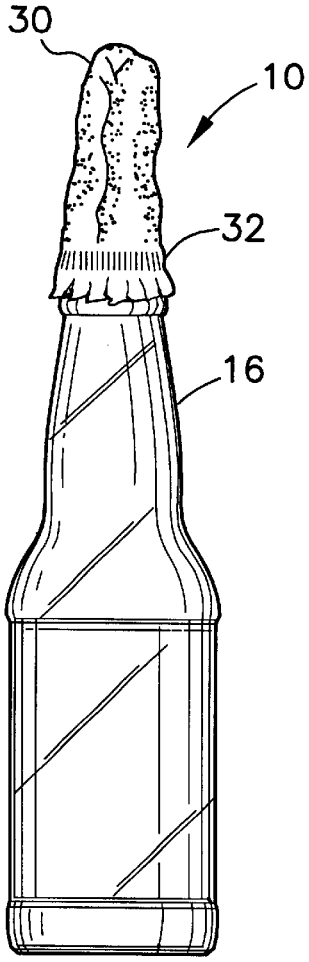
FIG. 2 is a side view of a typical beer container utilizing the present invention drink cap.
Figure 3:
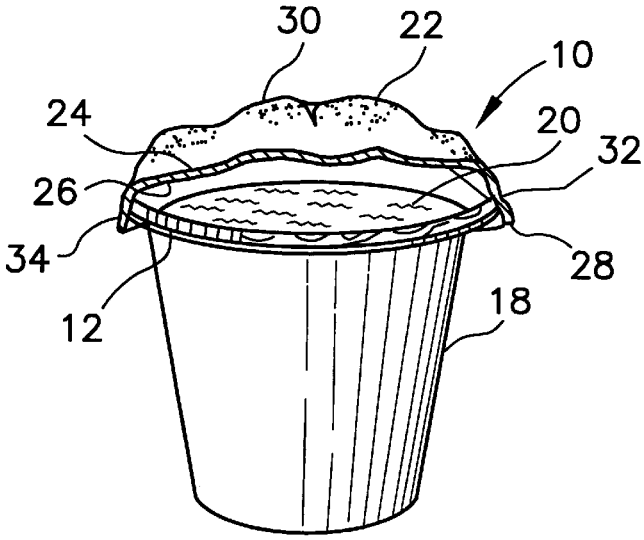
FIG. 3 is a side elevational view of a standard beverage container utilizing the present invention drink cap wherein the drink cap is sectioned.

As shown in FIGS. 1, 2 and 3, a drink cap 10, constructed in accordance with the present invention, is shown covering several different styles of beverage containers. More specifically in FIG. 1, the drink cap 10 is covering an opening 12 of a typical style wine glass 14. FIG. 2 shows the drink cap 10 covering the opening 12 of a typical style beer bottle 16. FIG. 3 shows the drink cap 10 covering the opening 12 of a typical style beverage cup 18, however the drink cap 10 is partially cross-sectioned to disclose several additional features of the drink cap 10.

Referring now to FIGS. 1 and 2, a single drink cap 10 may be utilized thereupon a wide mouthed beverage container such as the wine glass 14 and thereafter utilized thereupon the small mouthed beverage container such as the beer bottle 16.

Referring now to FIG. 3, the present invention is illustrated as a drink cap 10 particularly constructed to overlay the opening 12 of a beverage container 18 for protecting a beverage 20 in nightclub and bar type environments. The drink cap 10 includes at least one flexible sheet 22 having an outer surface 24, an inner surface 26, and an edge portion 28 located at an outermost periphery of the drink cap 10. The flexible sheet 22 is generally substantially circular in shape and includes a web portion 30, an elastic periphery region 32, and a skirt portion 34 located adjacent to the edge portion 28 of the drink cap 10.

Figure 6:
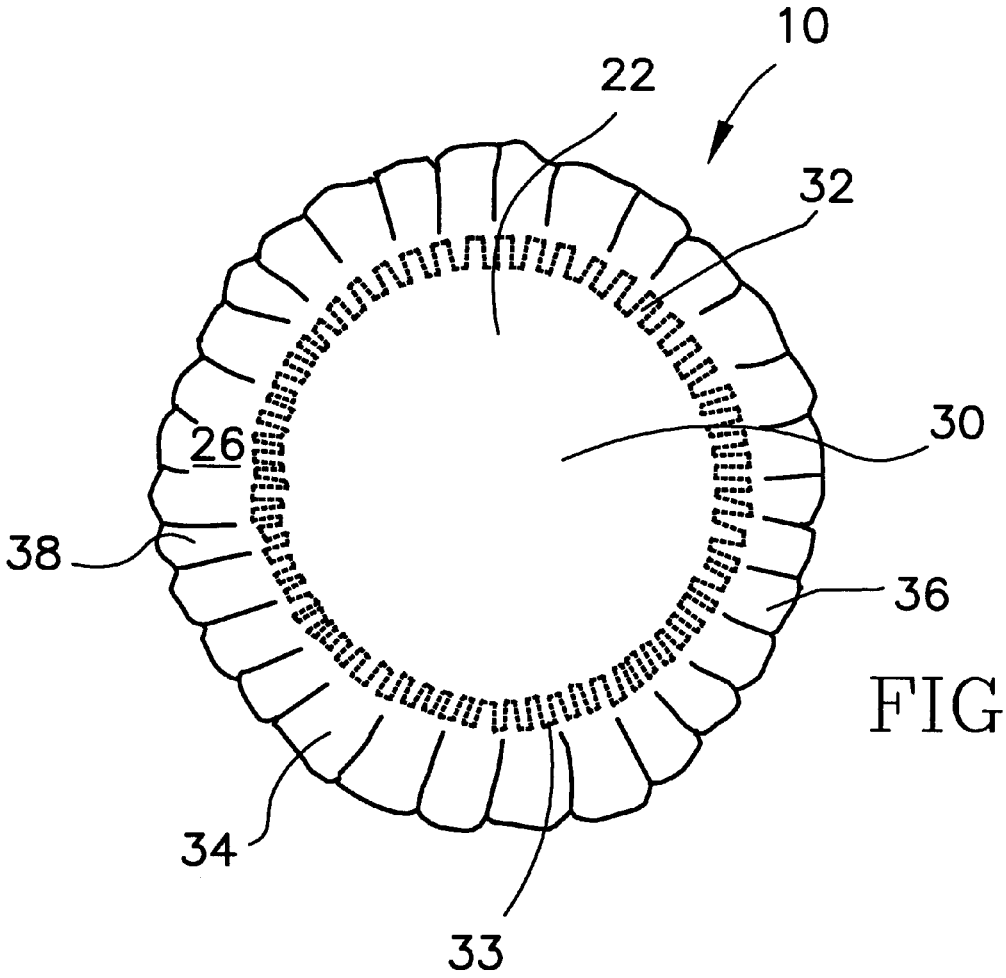
FIG. 6 is a bottom view of the present invention drink cap wherein the drink cap is fully dilated.

The flexible sheet 22 may be constructed from a flexible non-wetting material such as a combination of rubber and polyvinylchloride wherein the aforesaid material being sanitized or sterile so that any drinking surfaces are not contaminated. The elastic periphery region 32 is constructed from an elastic cord 33 (as shown in FIG. 6) secured to the flexible sheet 22 by adhesive, heat bonding, or other like methods of attachment. Attaching an elastic cord by heat bonding is sufficiently set forth by U.S. Pat. No. 4,691,390 issued to McKeown. An alternate construction of the drink cap 10 can be prepared by known techniques such as set forth in U.S. Pat. No. 4,846,827 issued to Sallee et al. and assigned to the Kimberly-Clark Corporation. Essentially, to economically and feasibly produce drink caps 10 such must be manufactured at high production rates using techniques such as invoking a "shirr" (an elasticized portion embedded and inherent therein the periphery of the flexible sheet) upon the flexible sheet 22. Yet another alternate construction includes the flexible sheet 22 having two connected layers of which a first layer 35 (not shown) provides the inner surface 26 and comprises a plastic sheet and a second layer 37 (not shown) provides the outer surface 24 and comprises a decorative paper sheet.

Figure 4:
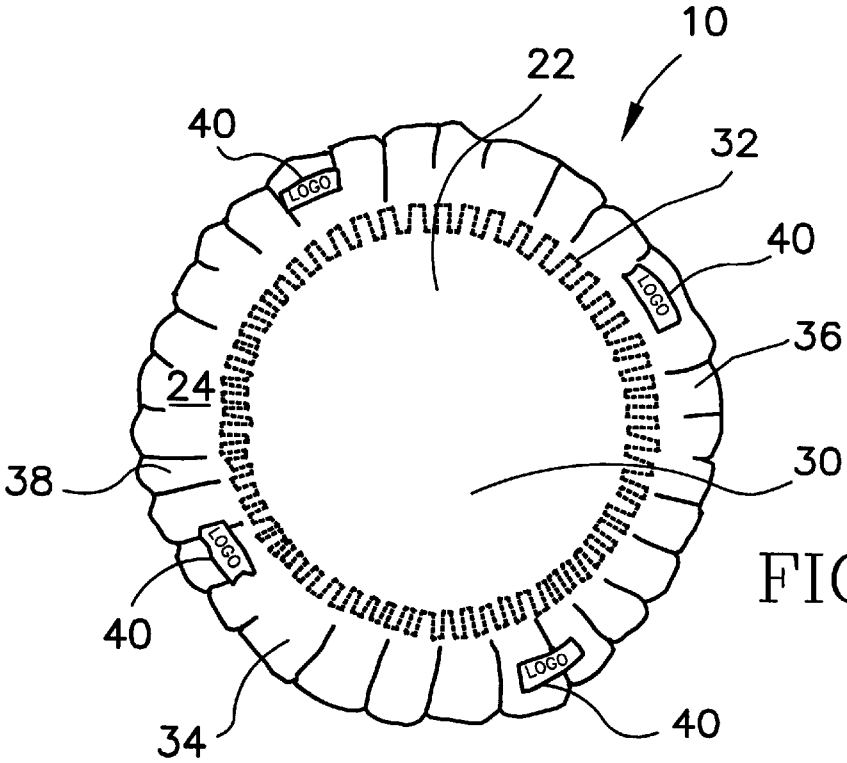
FIG. 4 is a top view of the present invention drink cap wherein the drink cap is fully dilated.

Now referring to FIG. 4, the drink cap 10 is fully dilated to receive the opening 12 of a beverage container (not shown in this view). Such dilation is generally carried out by the beverage consumer grasping the drink cap 10 with one hand at a first skirt portion 36 and with the other hand grasping the drink cap 10 at a second skirt portion 38 thereafter the beverage consumer moving his or her hands opposite and outwardly to fully dilate the elastic periphery region 32. The drink cap 10 is then placed on the mouth of the beverage container (not shown) and the user then releases the first and second skirt portions, 36, 38 respectively. The elastic periphery region 32, being in tension around the periphery of the beverage container (not shown), creates a snug fit wherein the elastic periphery region 32 is in firm contact with the beverage container(not shown). Located on the outer surface 24 of the flexible sheet 22 at a location on the skirt portion 34, a logo region 40 is reserved for placement of a logo or a beverage consumer's name. It should be readily understood by those skilled in the art that one or more logos may be located on any surface of the drink cap.

Figure 5:
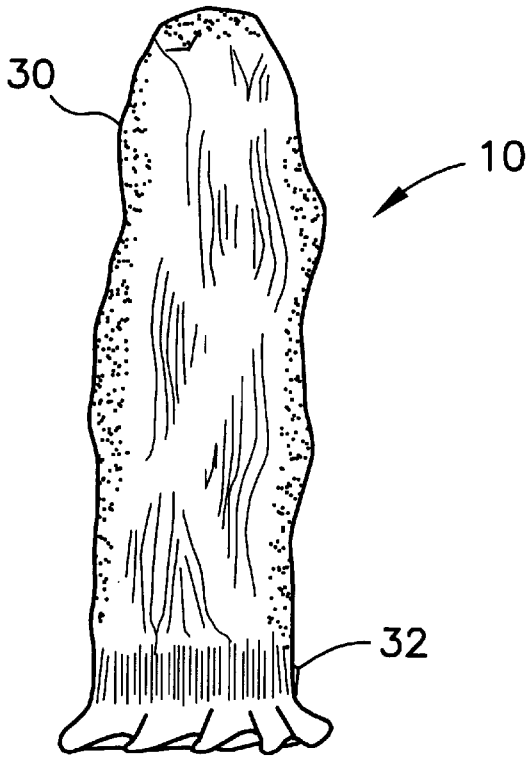
FIG. 5 is a front view of the drink cap of FIG. 4, wherein the drink cap is in a fully relaxed state.

Now referring to FIG. 5, the drink cap 10 is shown in a collapsed position wherein the elastic periphery region 32 is not dilated and the web portion 30 at the elastic periphery region 32 is substantially tightly constricted. When the elastic periphery region 32 is substantially tightly constricted the web portion 30 substantially gathers and becomes flaccid.

While the invention has been described in connection with a preferred embodiment, it will be understood that it is not intended that the invention be limited to that embodiment. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The foregoing discussion is illustrative of the invention. However, since many embodiments of the invention can be made without departing from the spirit and scope of the invention, the invention resides wholly in the claims hereinafter appended.

What is claimed is:

1. A drink cap for preventing foreign substances from entering an opening of a beverage container, comprising:

at least one flexible non-wetting sheet having an outer surface, an inner surface, an edge portion located at an outermost periphery of said at least one flexible sheet, a skirt portion located adjacent to and within the edge portion, an elastic periphery region capable of dilating located adjacent to and within the skirt portion, and a central web portion located adjacent to and within the elastic periphery region, whereby the central web portion of the inner surface of said at least one flexible sheet covers the opening of said beverage container;

at least one logo region, said at least one logo region located on the outer surface of said at least one flexible sheet; wherein said at least one logo region is located on the skirt portion of the outer surface of said at least one flexible sheet.

* * * * *